US009689337B2

(12) United States Patent
Nozaki

(10) Patent No.: US 9,689,337 B2
(45) Date of Patent: Jun. 27, 2017

(54) METHOD AND APPARATUS FOR CONTROLLING AN INTERNAL COMBUSTION ENGINE

(71) Applicant: TOYOTA JIDOSHA KABUSHIKI KAISHA, Toyota-shi, Aichi-ken (JP)

(72) Inventor: Tomohiro Nozaki, Nagoya (JP)

(73) Assignee: TOYOTA JIDOSHA KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/030,998

(22) PCT Filed: Nov. 5, 2014

(86) PCT No.: PCT/IB2014/002432
§ 371 (c)(1),
(2) Date: Apr. 21, 2016

(87) PCT Pub. No.: WO2015/068029
PCT Pub. Date: May 14, 2015

(65) Prior Publication Data

US 2016/0237938 A1 Aug. 18, 2016

(30) Foreign Application Priority Data

Nov. 7, 2013 (JP) ..... 2013-231262

(51) Int. Cl.
*F02D 41/08* (2006.01)
*F02D 41/24* (2006.01)
(Continued)

(52) U.S. Cl.
CPC ..... *F02D 41/2438* (2013.01); *F02D 41/0002* (2013.01); *F02D 41/08* (2013.01);
(Continued)

(58) Field of Classification Search
CPC ..... F02D 41/08; F02D 41/24; F02D 41/2438; F02D 41/0002; F02D 41/2441; F02D 41/2464; F02D 41/26; F02D 45/00
See application file for complete search history.

(56) References Cited

U.S. PATENT DOCUMENTS 7,305,967 B1 12/2007 Hagari et al.
9,273,624 B2 * 3/2016 Kobayashi ..... F02D 41/0097

FOREIGN PATENT DOCUMENTS

JP 2007-231884 A 9/2007
JP 2010-144555 A 7/2010
JP 2012-017679 A 1/2012

* cited by examiner

*Primary Examiner* — Hieu T Vo
(74) *Attorney, Agent, or Firm* — Oliff PLC

(57) ABSTRACT

A control apparatus for an engine, the control apparatus includes an ECU. The ECU is configured to: (i) estimate a characteristic value indicating divergence from a reference value of an intake air volume, (ii) store the characteristic value as a learned value, (iii) calculate the characteristic values for an opening degrees for which learning has not been completed, (iv) learn the characteristics of the throttle valve and reflect the characteristics in control of the intake air volume, (v) update the learned value at which an engine rotation speed is equal to or greater than an idling rotation speed during an initial engine operation after initialization of the learned values, (vi) update the learned value at which an engine rotation speed is lower than an idling rotation speed, by storing a value equal to the learned value for the smallest opening degree for which learning has already been completed.

4 Claims, 4 Drawing Sheets

(51) Int. Cl.

| | |
|---|---|
| ***F02D 45/00*** | (2006.01) |
| ***F02D 41/00*** | (2006.01) |
| ***F02D 41/26*** | (2006.01) |

(52) U.S. Cl.

CPC ..... *F02D 41/2441* (2013.01); *F02D 41/2464* (2013.01); *F02D 41/26* (2013.01); *F02D 45/00* (2013.01)

METHOD AND APPARATUS FOR CONTROLLING AN INTERNAL COMBUSTION ENGINE

BACKGROUND OF THE INVENTION

1. Field of the Invention

This invention relates to a control apparatus and a control method for an internal combustion engine.

2. Description of Related Art

There is a possibility that the characteristics of a throttle valve may vary with temporal change due to, for example, the accumulation of deposits. In other words, even at the same opening degree, the opening area becomes narrower as the accumulation of deposits progresses, and the intake air amount may be reduced.

In the control apparatus for an internal combustion engine described in Japanese Patent Application Publication No. 2012-17679 A (JP 2012-17679 A), the rate of change in the flow volume in each opening degree region which is divided in accordance with the opening degree of the throttle valve is learnt, so as to correspond to such temporal change in the characteristics of the throttle valve. The rate of change in the flow volume is an indicator which represents the extent of divergence between a reference value of the intake air volume and the value of the intake air volume which has actually been detected by an air flow meter. By using this change in the flow volume to correct the reference value of the intake air volume, then it is possible to determine the present characteristics of the throttle valve after temporal change has progressed.

JP 2012-17679 A indicates previously storing the initial value of the rate of change of the flow volume in the control apparatus for an internal combustion engine, and to use this initial value in an unlearnt opening degree region—an opening degree region for which learning has not been performed. JP 2012-17679 A indicates that, when there is an unlearnt opening degree region to the lower side of a learnt opening degree region, then a value equal to the learnt value in the opening degree region nearest to the unlearnt opening degree region, of the learnt opening degree regions, is used as a learnt value for this unlearnt opening degree region.

SUMMARY OF THE INVENTION

When the learnt value is initialized due to maintenance, or the like, then for an interim period after starting the engine, the throttle valve is controlled on the basis of the characteristics of the throttle valve as determined by using this initial value. Therefore, when the intake air volume at the same opening degree is reduced, due to the occurrence of temporal change in the throttle valve, then the intake air volume becomes insufficient and the engine rotation speed becomes lower than the idling rotation speed. Therefore, the engine rotation speed is kept lower than the idling rotation speed, and learning is carried out in the opening degree region of the throttle valve where the engine rotation speed is lower than this idling rotation speed.

However, when the opening degree of the throttle valve during an idling operation is controlled so as to become an opening degree that can maintain the idling rotation speed, by feedback control of the idling rotation speed, then learning is carried out in the opening degree region of the throttle valve at which the engine rotation speed is equal to or higher than the idling rotation speed. The throttle valve is then controlled thereafter on the basis of this learnt value. Therefore, after carrying out this learning process, the engine rotation speed is hardly ever kept lower than the idling rotation speed, and learning is hardly ever carried out again in the opening degree region where the engine rotation speed is lower than the idling rotation speed. As a result, the learnt value obtained by learning in the opening degree region of the throttle valve which yields an engine rotation speed lower than the idling rotation speed after initialization of the learnt values, is maintained and is not updated subsequently.

On the other hand, in the opening degree region where the engine rotation speed is equal to or greater than the idling rotation speed, the learnt value is updated frequently in accordance with the operation of the internal combustion engine. The characteristics of the throttle valve change in such a manner that the intake air volume gradually becomes less at the same valve opening, as temporal change (such as the accumulation of deposits) progresses. Therefore, the learnt value obtained by learning in the opening degree region where the engine rotation speed is equal to or greater than the idling rotation speed gradually decreases or increases progressively with temporal change. As opposed to this, the learnt value obtained by learning in the opening degree region where the engine rotation speed is lower than the idling rotation speed may hardly updated after having been provisionally learnt as described above. Therefore, divergence between the learnt value in the opening degree region where the engine rotation speed is lower than the idling rotation speed and the learnt value in the opening degree region where the engine rotation speed is equal to or higher than the idling rotation speed becomes greater, as the temporal change of the throttle valve progresses. The characteristics of the throttle valve at an opening degree for which learning has not been completed are estimated by linear interpolation using the respective learnt values. Therefore, when the opening degree of the throttle valve varies between an opening degree region where the learnt value is updated frequently as described above and an opening degree region where the learnt value is not updated, then there is a possibility of an excessively large range of increase/decrease in the intake air amount with the change in the opening degree. In other words, there is a possibility that the characteristics of the throttle valve may vary greatly between an opening degree region where the engine rotation speed is lower than the idling rotation speed, and an opening degree region where the engine rotation speed is equal to or greater than the idling rotation speed. Consequently, there is a possibility of decline in the control of the intake air volume of the internal combustion engine.

This invention provides a control apparatus for an internal combustion engine whereby decline in the control of the intake air volume can be suppressed.

A first aspect of this invention is a control apparatus for an internal combustion engine, the control apparatus includes an electronic control unit. The electronic control unit is configured to: (i) estimate a characteristic value indicating divergence from a reference value of an intake air volume, based on an actually detected indicator value of the intake air volume and an opening degree of a throttle valve; (ii) store the characteristic value as a learnt value in association with the opening degree of the throttle valve at the time when the indicator value is detected; (iii) calculate, in association with each opening degree of the throttle valve, the characteristic value for an opening degree of the throttle valve for which learning has not been completed, by linear interpolation using the learnt values; (iv) learn the characteristics of the throttle valve and reflect the characteristics in control of the intake air volume, based on the characteristic values associated with the opening degrees; (v) update the learnt value for an opening degree of the throttle valve at which an engine rotation speed is equal to or greater than an idling rotation speed, by associating the characteristic value with the opening degree of the throttle valve at the time when the indicator value is detected and storing the characteristic value and the opening degree of the throttle valve at the time when the indicator value is detected, during an initial engine operation after initialization of the learnt values; and (vi) update the learnt value for an opening degree of the throttle valve at which the engine rotation speed is less than the idling rotation speed, by storing a value equal to the learnt value for the smallest opening degree for which learning has already been completed, of the opening degrees at which the engine rotation speed is equal to or greater than the idling rotation speed.

According to the composition described above, when an initial engine operation after initialization of the learnt values, the electronic control unit stores a value equal to the learnt value for the smallest opening degree for which learning has been completed, of the opening degrees at which the engine rotation speed is equal to or greater than the idling rotation speed. Thus, the learnt values are updated for opening degrees of the throttle valve at which the engine rotation speed is lower than the idling rotation speed. According to an updating of this kind, the occurrence of deviation between the learnt value for an opening degree where the engine rotation speed is less than the idling rotation speed and the learnt value for the smallest opening degree for which the learnt value has already been completed, of the opening degrees at which the engine rotation speed is equal to or greater than the idling rotation speed, is suppressed. Consequently, increase and decrease in the learnt values in accordance with change in the opening degree is suppressed, when the opening degree of the throttle valve is varied between these opening degrees. As a result, it is possible to suppress excessive increase in the range of increase and decrease of the learnt values in accordance with change in the opening degree of the throttle valve. Consequently, it is possible to suppress large variation in the characteristics of the throttle valve which are corrected by using the characteristic values that are associated with the respective opening degrees, between the opening degree region at which the engine rotation speed is lower than the idling rotation speed, and the opening degree region at which the engine rotation speed is equal to or greater than the idling rotation speed. Therefore, the decline in control of the intake air volume can be suppressed.

Furthermore, during an initial engine operation after initialization of the learnt values, there is a possibility that the engine rotation speed will be kept lower than the idling rotation speed. On the other hand, when learning is carried out provisionally at an opening degree where the engine rotation speed is equal to or greater than the idling rotation speed during an initial engine operation, then the throttle valve may be hardly controlled thereafter in such a manner that the engine rotation speed is lower than the idling rotation speed. In other words, even in cases where updating of the learnt values is carried out during the second and subsequent engine operations after the initialization of the learnt values, by storing, in association with opening degrees of the throttle valve, characteristic values calculated on the basis of the indicator values of the intake air volume which have actually been detected, there may be virtually no occasions where the learnt values are updated for an opening degree at which the engine speed is lower than the idling rotation speed.

According to the configuration described above, updating of the learnt values described above is carried out during an initial engine operation after initialization of the learnt values. Therefore, in circumstances which are liable to give rise to a large deviation between the learnt values at opening degrees where the engine rotation speed is lower than the idling rotation speed and the learnt values at opening degrees where the engine rotation speed is equal to or greater than the idling rotation speed, it is still possible to update the learnt values so as to suppress deviation of this kind.

When an initial value is used as the characteristic value for an opening degree for which learning has not been completed, then a large deviation may occur between the learnt values at the opening degrees for which learning has already been completed, and the characteristic value which is associated with the opening degrees for which learning has not been completed. Consequently, there may be a large variation in the characteristics of the throttle valve, between the opening degree region where learning has been completed and the opening degree region where learning has not been completed.

According to the composition described above, the characteristic value for an opening for which learning has not been completed is calculated by linear interpolation using the respective learnt values. Therefore, compared to a case where a previously set initial value is used as a characteristic value associated with an opening degree for which learning has not been completed, the deviation between the learnt value for an opening degree for which learning has been completed and a characteristic value associated with an opening degree for which learning has not been completed becomes smaller. Therefore, according to the composition described above, it is possible to suppress the occurrence of large variation in the characteristics of the throttle valve, between the opening degree region where learning has been completed and the opening degree region where learning has not been completed, and the control of the intake air volume can be improved.

In the control apparatus described above, the electronic control unit may be configured to update the learnt values for the respective opening degrees and make divergence between the learnt value before updating and the learnt value after updating less than a predetermined value. According to the composition described above, since the amount of change is limited in the updating of the learnt values, then it is possible to suppress sudden changes in the learnt values. As a result of this, it is possible to suppress large variation, before updating and after updating, in the learnt values, and in the characteristics of the throttle valve which are corrected by using characteristic values calculated by linear interpolation from these learnt values.

A second aspect of this invention is a control method for an internal combustion engine, the control method includes: estimating a characteristic value indicating divergence from a reference value of an intake air volume, based on an actually detected indicator value of the intake air volume and an opening degree of a throttle valve; storing the characteristic value as a learnt value in association with the opening degree of the throttle valve at the time when the indicator value is detected; calculating, in association with each opening degree of the throttle valve, the characteristic value for an opening degree of the throttle valve for which learning has not been completed, by linear interpolation using the learnt values; learning the characteristics of the throttle valve and reflecting the characteristics in control of the intake air volume, based on the characteristic values associated with the opening degrees; updating the learnt value for an opening degree of the throttle valve at which an engine rotation speed is equal to or greater than an idling rotation speed, by associating the characteristic value with the opening degree of the throttle value at the time when the indicator value is detected and storing the characteristic value and the opening degree of the throttle valve at the time when the indicator value is detected, during an initial engine operation after initialization of the learnt values; and updating the learnt value for an opening degree of the throttle valve at which the engine rotation speed is less than the idling rotation speed, by storing a value equal to the learnt value for the smallest opening degree for which learning has already been completed, from among the opening degrees at which the engine rotation speed is equal to or greater than the idling rotation speed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Below, a first embodiment of a control apparatus for an internal combustion engine is described with reference to FIGS. 1 to 5C.

Figure 1:
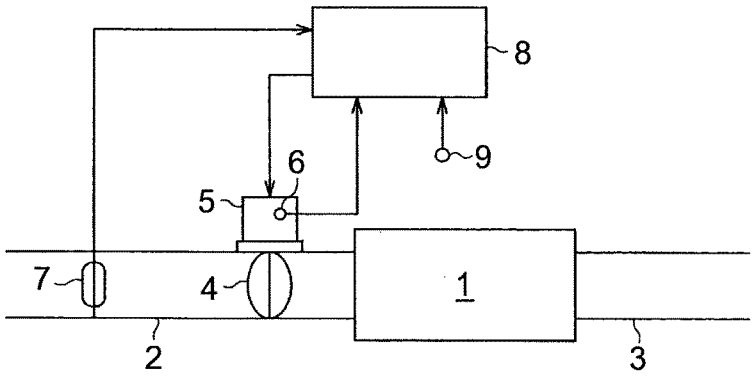
FIG. 1 is a schematic drawing showing a relationship between a control apparatus for an internal combustion engine according to a first embodiment and an internal combustion engine which is a control object of the apparatus.

As shown in FIG. 1, an air intake passage 2 and an exhaust gas passage 3 are connected respectively to a combustion chamber 1 of an internal combustion engine. A throttle valve 4 is provided in the air intake passage 2. The throttle valve 4 adjusts the volume of the intake air which is introduced into the combustion chamber 1 by the opening degree thereof. The throttle valve 4 is driven by the throttle motor 5. The throttle motor 5 has an in-built throttle sensor 6 for detecting the opening degree of the throttle valve 4. An air flow meter 7 for detecting the intake air volume flowing in the air intake passage 2 is disposed in a portion of the air intake passage 2 to the upstream side of the throttle valve 4 in terms of the flow of intake air.

An electronic control unit 8 which implements overall control of the internal combustion engine is provided in the internal combustion engine. Detection signals are input to the electronic control unit 8 from various sensors that are provided in the internal combustion engine such as: the air flow meter 7, the throttle sensor 6 and a crank angle sensor 9, and the like. The crank angle sensor 9 detects the engine rotation speed NE of the internal combustion engine. The electronic control unit 8 executes various calculation processes on the basis of these determination signals, and controls the internal combustion engine accordingly. For example, the electronic control unit 8 calculates a flow volume loss rate, as a characteristic value that indicates divergence between the detected value of the intake air volume which is actually detected by the air flow meter 7 and a reference value for the intake air volume estimated from the opening degree of the throttle valve 4. The electronic control unit 8 executes learning control for storing learnt values which associate the flow volume loss rate with the opening degree of the throttle valve 4 when the detected value is detected. The electronic control unit 8 calculates and associates the flow volume loss rate at an opening degree for which learning has not been completed, in association with each opening degree, by linear interpolation using learnt values which have been obtained by learning control. The electronic control unit 8 learns the characteristics after temporal change of the throttle valve 4, on the basis of the flow volume loss rate associated with each opening degree, and executes intake air amount control to control the amount of air taken into the combustion chamber 1 on the basis of the characteristics of the throttle valve 4 after learning.

Figure 2:
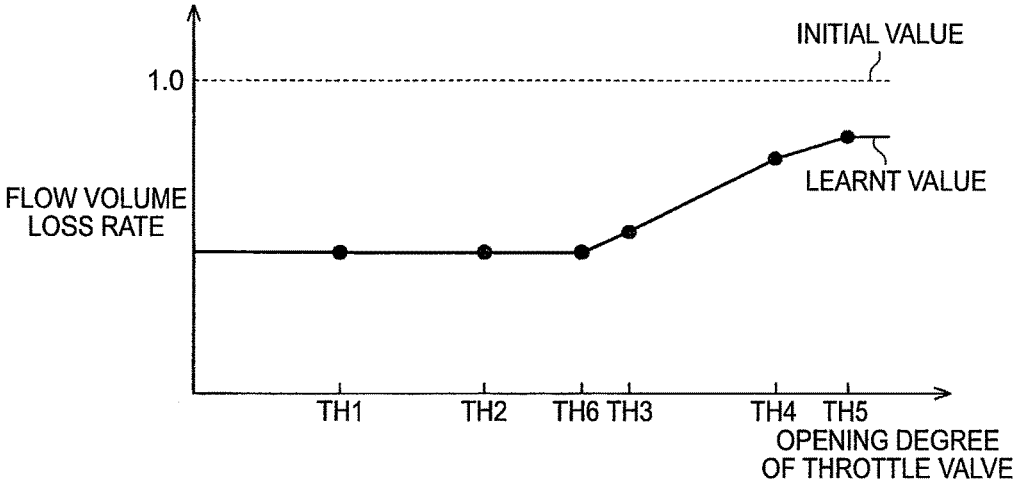
FIG. 2 is a graph showing a relationship between learnt values and opening degrees of a throttle valve which are stored in a control apparatus for an internal combustion engine according to the embodiment.

The learning control is now described with reference to FIGS. 2 and 3. As shown in FIG. 2, an initial value of the flow volume loss rate is stored previously in the electronic control unit 8. This initial value is set to "1.0" for all of the opening degrees of the throttle valve 4. The flow volume loss rate is a ratio which indicates the extent to which the detected value of the intake air amount actually detected by the air flow meter 7 diverges from a reference value of the intake air volume estimated from the opening degree of the throttle valve 4, and the value of the flow volume loss rate is found by dividing the detected value by the reference value. Therefore, when no divergence occurs between the detected value and the reference value, then the rate is "1.0". On the other hand, when the intake air volume becomes smaller at the same opening degree due to the occurrence of temporal change in the throttle valve 4, then the detected value falls, the divergence between the detected value and the reference value becomes greater, and therefore the flow volume loss rate becomes a value lower than "1.0". In other words, the flow volume loss rate has a tendency to decrease gradually from the initial value, with temporal change in the throttle valve 4.

When prescribed learning conditions are established during execution of engine operation, for instance, when the opening degree of the throttle valve 4 is uniform and the engine rotation speed NE is stable, then the electronic control unit 8 calculates the flow volume loss rate from the divergence between the detected value of the intake air volume actually detected by the air flow meter 7 and the reference value of the intake air volume at the opening degree of the throttle valve 4 at which the detected value is detected. The electronic control unit 8 stores learnt values which associate the flow volume loss rate with the opening degree of the throttle valve 4 at the time that the detected value is detected. In other words, a learnt value is a flow volume loss rate which has been associated with an opening degree of the throttle valve 4 and has been stored in the electronic control unit 8.

FIG. 2 is a graph showing an initial value of the learnt value, and the learnt values for the opening degrees TH1, TH2, TH3, TH4, TH5 and TH6 of the throttle valve 4. When the learnt values are updated, the electronic control unit 8 calculates the flow volume loss rates at opening degrees for which learning has not been completed, in accordance with the respective opening degrees, by linear interpolation using the learnt values for the respective opening degrees for which learning has already been completed, as shown by the solid line in FIG. 2. When the flow volume loss rate is calculated in this way, the characteristics of the present throttle valve 4 after the progression of temporal change are learnt on the basis of these flow volume loss rates.

Figure 3:
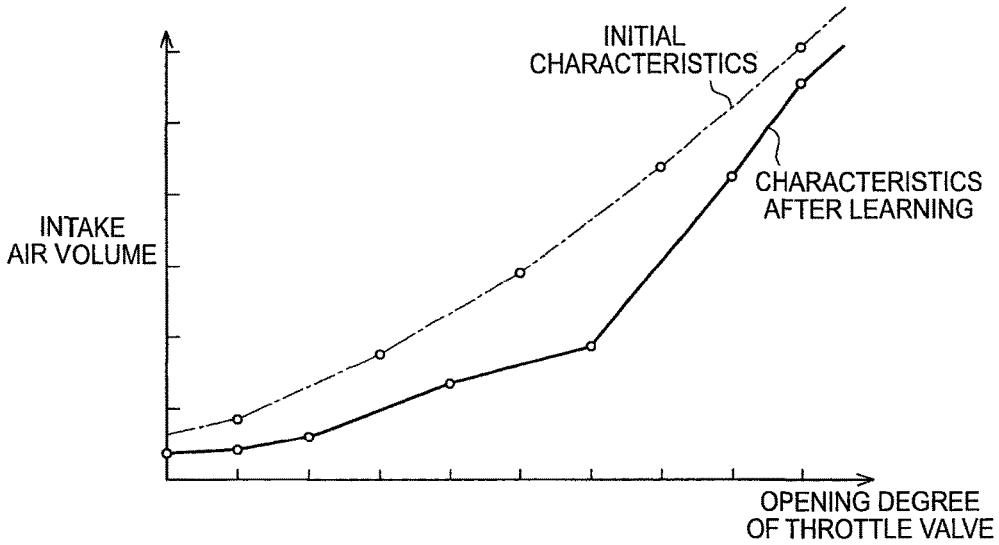
FIG. 3 is a graph showing initial characteristics and characteristics after learning of a throttle valve which are stored in a control apparatus for an internal combustion engine according to the embodiment.

As indicated by the single-dotted line in FIG. 3, the electronic control unit 8 previously stores, as a map value, initial characteristics indicating the relationship between the opening degree of the throttle valve 4 and the amount of intake air estimated from this opening degree. By correcting the initial characteristics by multiplying by the flow volume loss rate, for instance, on the basis of these initial characteristics and the flow volume loss rate, then as shown by the solid line in FIG. 3, the present characteristics of the throttle valve 4 after the progression of temporal change are learnt. The electronic control unit 8 executes control of the intake air volume on the basis of the characteristics after this learning process.

Next, a series of processing involved in updating the learnt values in the learning control will be described with reference to the flowchart in FIG. 4. This process is executed repeatedly at a predetermined cycle, by the electronic control unit 8.

Figure 4:
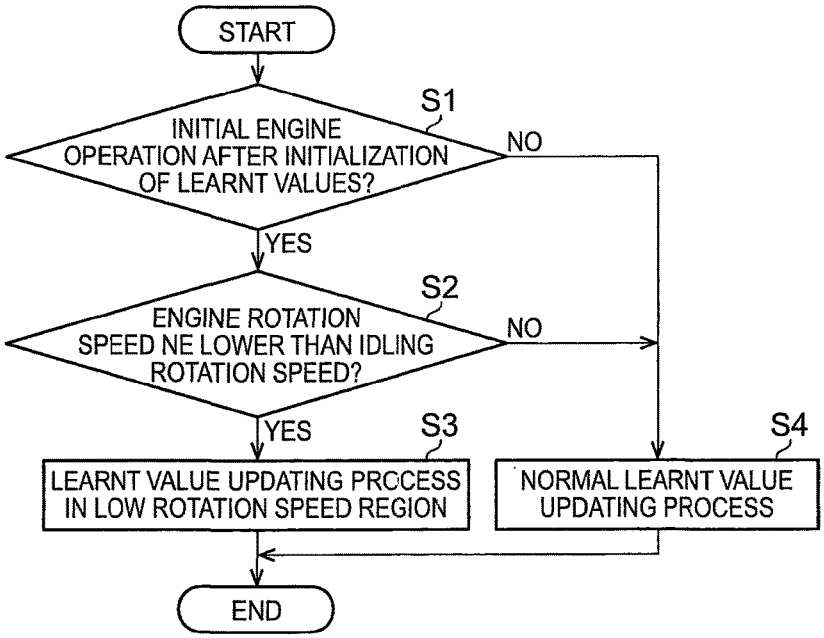
FIG. 4 is a flowchart showing the sequence of a series of processes involved in updating of the learnt values which is executed in the control apparatus for an internal combustion engine according to the embodiment.

As shown in FIG. 4, firstly, the electronic control unit 8 judges whether or not an initial engine operation is being performed after initialization of the learnt values (step S1). In the process of this step S1, when the flow volume loss rate is set to an initial value of "1.0" for all of the opening degrees, then the electronic control unit 8 judges that the learnt values have been initialized. The period from the initial start of the engine after initialization of the learnt values until stopping of the engine is taken to be an initial engine operation. When a negative determination is made in the process in step S1 (step S1: NO), in other words, when the learnt values have not been initialized or when the learnt values have been initialized but the engine is not performing an initial operation, the electronic control unit 8 executes a normal learnt value updating process (step S4), and the electronic control unit 8 ends the process. In a normal learnt value updating process, as described above, when prescribed learning conditions are established and the flow volume loss rate is calculated on the basis of the detected value of the intake air volume which is actually detected, then the learnt values are updated by storing this flow volume loss rate in association with the opening degree of the throttle valve 4.

On the other hand, when an affirmative determination is made in the process in step S1 (step S1: YES), then the procedure transfers to the process in step S2. In the process in step S2, it is confirmed whether or not the engine rotation speed NE is lower than the idling rotation speed. When a negative determination is made in the process in step S2 (step S2: NO), in other words, when it is determined that the engine rotation speed NE is equal to or greater than the idling rotation speed, the electronic control unit 8 executes a normal learnt value updating process is executed (step S4), and the electronic control unit 8 ends the processing.

On the other hand, when an affirmative determination is made in the process in step S2 (step S2: YES), in other words, when the electronic control unit 8 determines that the engine is performing an initial engine operation after initialization of the learnt values and that the engine rotation speed NE is lower than the idling rotation speed, the electronic control unit 8 executes a learnt value updating process in the low rotation speed region (step S3), and the electronic control unit 8 ends the process. In the learnt value updating process in the low rotation speed region, updating of the learnt values is not performed by storing the flow volume loss rate calculated on the basis of the detected value of the intake air volume which has actually been detected, in association with the opening degree of the throttle valve 4. As an alternative to this, the electronic control unit 8 updates the learnt value for an opening degree of the throttle valve where the engine rotation speed NE is lower than the idling rotation speed, by storing a value equal to the learnt value for the smallest opening, degree for which learning has already been completed, of the opening degrees at which the engine rotation speed NE is equal to or greater than the idling rotation speed.

Next, the action of this embodiment will be described with reference to FIGS. 5A to 5C. When the learnt values are initialized, the throttle valve 4 is controlled on the basis of the initial characteristics for an interim period after starting the engine. Therefore, when the intake air volume at the same opening becomes less due to the occurrence of temporal change in the throttle valve 4, the intake air volume may become insufficient and the engine rotation speed NE may become lower than the idling rotation speed, and hence the engine rotation speed NE may be kept below the idling rotation speed. As a result of this, there may be cases where learning is carried out in this rotation speed region.

In this embodiment, during the initial engine operation after initialization of the learnt values, the mode of the updating process is switched in accordance with the engine rotation speed NE, and in the low rotation speed region where the engine rotation speed NE is lower than the idling rotation speed, updating of the learnt values is not carried out by a normal learnt value updating process. As an alternative to this, the learnt values are updated by storing a value equal to the learnt value for the smallest opening degree for which learning has already been completed, of the opening degrees at which the engine rotation speed NE is equal to or greater than the idling rotation speed.

Figure 5A:
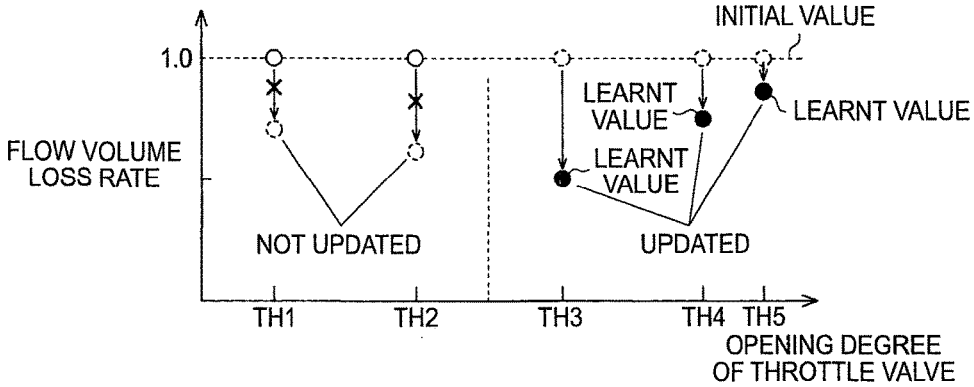
FIG. 5A is a graph showing a schematic view of updating of the learnt values which is executed in the control apparatus for an internal combustion engine according to the embodiment, and shows updating of the learnt values for each opening degree.

Therefore, as shown in FIG. 5A, even when the flow volume loss rates at the opening degrees TH1 and TH2 of the throttle valve 4 in the opening degree range where the engine rotation speed NE is lower than the idling rotation speed are calculated respectively, these values are not stored as learnt values for the respective opening degrees TH1 and TH2.

On the other hand, when the engine rotation speed NE is equal to or greater than the idling rotation speed, updating of the learnt values is executed by the normal learnt value updating process. Therefore, when the flow volume loss rates at the opening degrees TH3, TH4 and TH5 are respectively calculated, the values are stored respectively as learnt values for the respective opening degrees TH3, TH4 and TH5.

Figure 5B:
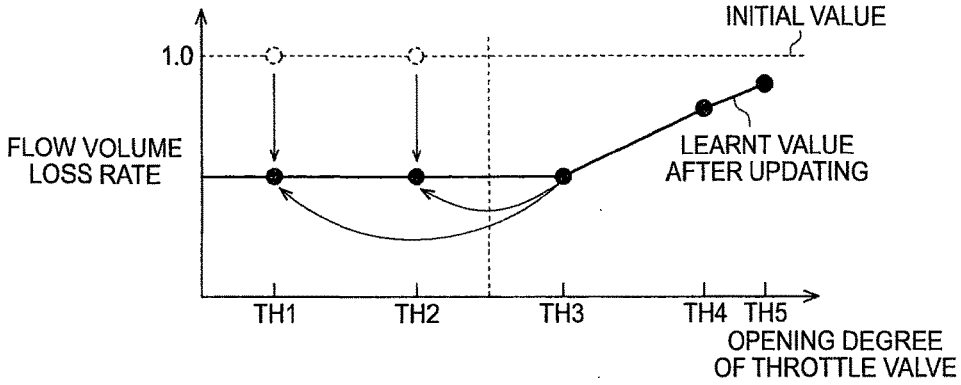
FIG. 5B is a graph showing a schematic view of updating of the learnt values which is executed in the control apparatus for an internal combustion engine according to the embodiment, and shows a state where linear interpolation is carried out between the learnt values.

As shown in FIG. 5B, when the learnt value at the opening degree where the engine rotation speed NE is equal to or greater than the idling rotation speed is updated, then the learnt values for the opening degrees TH1 and TH2 of the throttle valve 4 where the engine rotation speed NE is lower than the idling rotation speed are updated by storing a value equal to the learnt value at the opening degree TH3. In other words, the learnt value at the opening degree where the engine rotation speed NE is lower than the idling rotation speed is updated by storing a value equal to the learnt value for the smallest opening degree TH3 for which learning has already been completed, of the opening degrees at which the engine rotation speed NE is equal to or greater than the idling rotation speed. As a result of this, the respective learnt values for the opening degrees TH1, TH2 and TH3 are the same value. A flow volume loss rate at the opening degree of the throttle valve for which learning has not been completed is calculated by the linear interpolation described above.

Figure 5C:
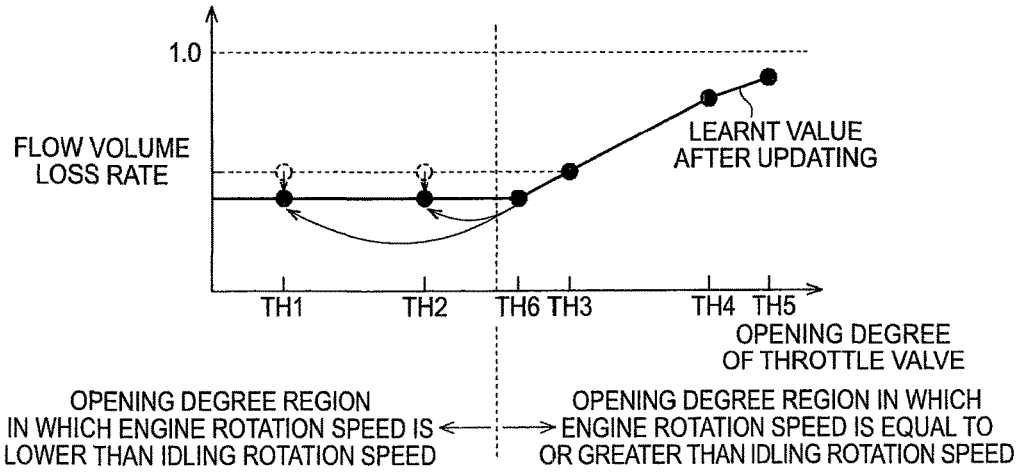
FIG. 5C is a graph showing a schematic view of updating of the learnt values which is executed in the control apparatus for an internal combustion engine according to the embodiment, and shows a state where the learnt values are newly updated.

Thereafter, as shown in FIG. 5C, when the learnt value is updated newly at the opening degree TH6 which is an opening degree smaller than the opening degree TH3, of the opening degrees of the throttle valve 4 where the engine rotation speed NE is equal to or greater than the idling rotation speed, then the learnt value for the opening degree TH6 is set to the learnt value of the smallest opening degree for which learning has already been performed, of the opening degrees at which the engine rotation speed NE is equal to or greater than the idling rotation speed. Therefore, a value equal to the learnt value at the opening degree TH6 is newly stored as the respective learnt values for the opening degrees TH1 and TH2, and consequently the learnt values for the opening degrees TH1, TH2 and TH6 are the same value. The flow volume loss rate is calculated in association with opening degrees for which learning has not yet been completed, by linear interpolation using the updated learnt values.

As described above, in this embodiment, when the engine rotation speed NE is lower than the idling rotation speed, updating of the learnt values is not performed by storing the flow volume loss rate calculated on the basis of the detected value of the intake air volume which is actually detected, in association with the opening degree of the throttle valve 4. As an alternative to this, the learnt value at the opening degree where the engine rotation speed NE is lower than the idling rotation speed is updated by storing a value equal to the learnt value for the smallest opening degree for which learning has already been completed, of the opening degrees at which the engine rotation speed NE is equal to or greater than the idling rotation speed. According to an updating method of this kind, no divergence occurs between the learnt value for an opening degree where the engine rotation speed NE is lower than the idling rotation speed and the learnt value for the smallest opening degree for which the learnt value has already been completed, of the opening degrees at which the engine rotation speed NE is equal to or greater than the idling rotation speed. Consequently, increase and decrease in the learnt values is not liable to occur with change in the opening degree, when the opening degree of the throttle valve 4 is varied between these opening degrees.

Furthermore, during an initial engine operation after initialization of the learnt values, the engine rotation speed NE may be kept lower than the idling rotation speed. However, when learning is carried out provisionally at an opening degree where the engine rotation speed NE is equal to or greater than the idling rotation speed during an initial engine operation, the throttle valve 4 may be hardly controlled thereafter in such a manner that the engine rotation speed NE is lower than the idling rotation speed. In other words, even in cases where updating of the learnt values is carried out during the second and subsequent engine operations after the initialization of the learnt values, by storing flow volume loss rates calculated on the basis of the detected values of the intake air volume which have actually been detected, in association with the opening degree of the throttle valve 4, there are virtually no occasions where the learnt values are updated for an opening degree at which the engine speed is lower than the idling rotation speed.

In this respect, according to this embodiment, the learnt value updating process in the low rotation speed region described above is carried out during an initial engine operation after initialization of the learnt values. Therefore, in circumstances where a large divergence is liable to occur between the learnt values at opening degrees where the engine rotation speed NE is lower than the idling rotation speed, and the learnt values at opening degrees where the engine rotation speed NE is equal to or greater than the idling rotation speed, such as an initial engine operation after initialization of the learnt values, then the learnt values are updated in such a manner that divergence of this kind is suppressed.

When an initial value is used as the flow volume loss rate for an opening degree for which learning has not been completed, then a large divergence may occur between the learnt values at the opening degrees for which learning has already been completed, and the flow volume loss rate (initial value) which is associated with the opening degrees for which learning has not been completed. Consequently, there may be large variation in the characteristics of the throttle valve 4, between the opening degree region where learning has been completed and the opening degree region where learning has not been completed.

In this embodiment, the flow volume loss rate at an opening for which learning has not been completed is calculated by linear interpolation using the respective learnt values. In an internal combustion engine, the intake air volume required to maintain an idling operation varies depending on the friction and/or engine load during operation of the engine. Therefore, when it is determined whether or not the engine rotation speed NE is lower than the idling rotation speed, on the basis of whether or not the opening degree of the throttle valve 4 is less than a prescribed opening degree, then there is a possibility that this determination will not be performed accurately. Even in cases where a minimum flow volume of the intake air volume required in order to maintain an idling rotation speed is set in advance, and it is determined whether or not the engine rotation speed NE is lower than the idling rotation speed on the basis of whether or not the intake air volume is lower than this minimum flow volume, since the minimum flow volume varies with the friction, and the like, during operation of the engine, then there is a possibility that this determination will not be performed accurately.

In this embodiment, the engine rotation speed NE is detected by the crank angle sensor 9, and it is determined whether or not the actual engine rotation speed NE is lower than the idling rotation speed. Therefore, even when there is variation in the friction and/or the engine load during engine operation, it is possible to accurately determine whether or not the engine rotation speed NE is lower than the idling rotation speed.

According to the first embodiment described above, the following beneficial effects are obtained. It is possible to suppress excessive increase in the range of increase and decrease of the learnt values due to change in the opening degree of the throttle valve 4. Consequently, it is possible to suppress large variation in the characteristics of the throttle valve 4 which are corrected by using the flow volume loss rates that are associated with the respective opening degrees, between the opening degree region at which the engine rotation speed is lower than the idling rotation speed, and the opening degree region at which the engine rotation speed is equal to or greater than the idling rotation speed. Therefore, the decline in control of the intake air volume can be suppressed.

During an initial engine operation after initialization of the learnt values, a learnt value updating process in the low rotation speed region is executed. Therefore, in circumstances which are liable to give rise to a large divergence between the learnt values at opening degrees where the engine rotation speed is lower than the idling rotation speed and the learnt values at opening degrees where the engine rotation speed is equal to or greater than the idling rotation speed, it is possible to update the learnt values so as to suppress divergence of this kind.

Since the flow volume loss rate at an opening degree for which learning has not been completed is calculated by linear interpolation using the learnt values for opening degrees for which learning has already been completed, then it is possible to suppress divergence between the learnt values at the opening degrees for which learning has already been completed, and the flow volume loss rate at the opening degrees for which learning has not been completed. Therefore, it is possible to suppress the occurrence of large variation in the characteristics of the throttle valve 4, between the opening degree region where learning has been completed and the opening degree region where learning has not been completed, and the control of the intake air volume can be improved.

Next, a second embodiment of the invention will be described with reference to FIGS. 6A to 6C. This embodiment differs from the first embodiment described above in that the learnt values for the respective opening degrees are updated in such a manner that the learnt values before updating and the learnt value after updating do not diverge by a predetermined value or higher. Furthermore, processing that is similar to the first embodiment is not described in detail here.

In this embodiment, when flow volume loss rates are calculated newly in association with respective opening degrees of the throttle valve 4, it is determined whether or not the newly calculated flow volume loss rate and the currently stored learnt value diverge from each other by a predetermined value a or higher. When it is determined that the newly calculated flow volume loss rate and the currently stored learnt value do not diverge by the predetermined value a or higher, then the learnt value is updated by storing the newly calculated flow volume loss rate as the learnt value. When it is determined that the newly calculated flow volume loss rate and the currently stored learnt value diverge by the predetermined value a or higher, then the learnt value is updated by limiting the learnt value in such a manner that the divergence between the learnt values before and after updating is the predetermined value a or higher. In other words, the learnt value is updated by storing a value obtained by subtracting the predetermined value a from the currently stored learnt value, as the new learnt value, rather than storing the newly calculated flow volume loss rate. By performing the updating of learnt values by a method of this kind, the learnt values for respective opening degrees are updated in such a manner that the learnt value before updating and the learnt value after updating do not diverge by the predetermined value a or higher.

Figure 6A:
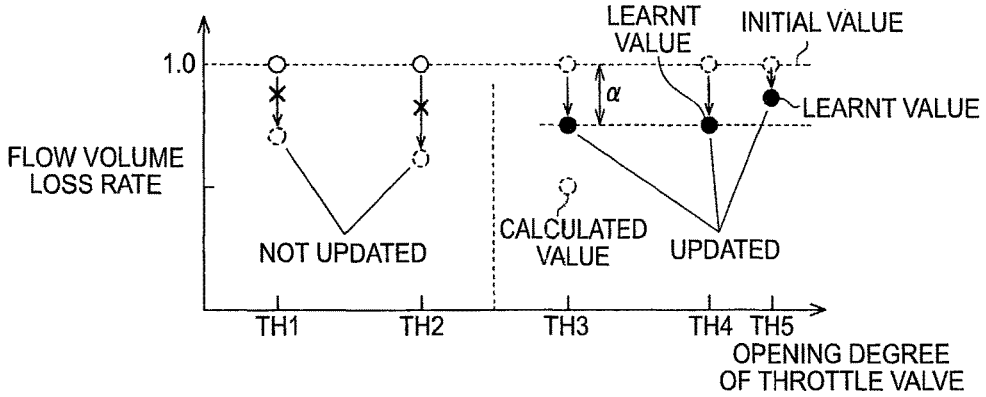
FIG. 6A is a graph showing a schematic view of updating of the learnt values which is executed in the control apparatus for an internal combustion engine according to a second embodiment, and shows updating of the learnt values for each opening degree.
Figure 6B:
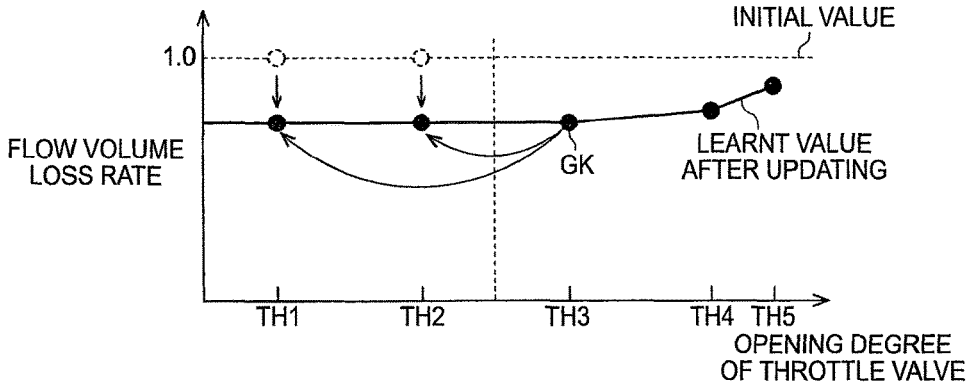
FIG. 6B is a graph showing a schematic view of updating of the learnt values which is executed in the control apparatus for an internal combustion engine according to the embodiment, and shows a state where linear interpolation is carried out between the learnt values.
Figure 6C:
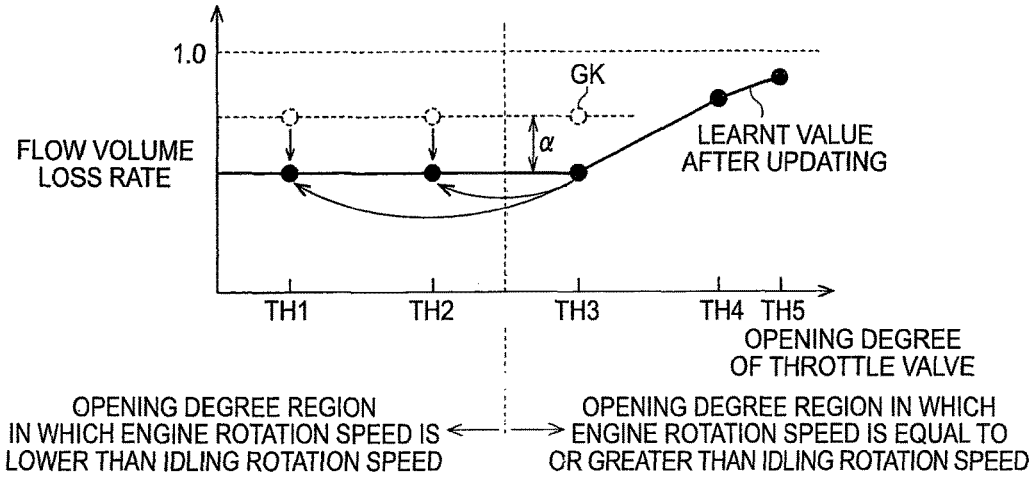
FIG. 6C is a graph showing a schematic view of updating of the learnt values which is executed in the control apparatus for an internal combustion engine according to the embodiment, and shows a state where the learnt values are newly updated.

The action of this embodiment is described here with reference to FIGS. 6A to 6C. As shown in FIG. 6A, at the opening degrees TH4 and TH5 of the throttle valve 4, the respective flow volume loss rates calculated newly at the respective opening degrees do not diverge by the predetermined value a or higher from the learnt value before updating (the initial value). Consequently, the learnt values are updated by storing the newly calculated flow volume loss rates in association with the respective opening degrees.

On the other hand, at the opening degree TH3 of the throttle valve 4, the flow volume loss rate newly calculated for that opening degree diverges by the predetermined value a or higher from the learnt value before updating (initial value). Therefore, the learnt value for the opening degree TH3 is updated by storing a value obtained by subtracting the predetermined value a from the initial value.

As shown in FIG. 6B, the opening degree TH3 is the smallest opening degree for which learning has already been completed, of the opening degrees at which the engine rotation speed NE is equal to or greater than the idling rotation speed. Therefore, when the learnt value GK at the opening degree TH3 is updated, a value equal to this learnt value GK is stored as a learnt value for the opening degrees TH1 and TH2. Subsequently, the flow volume loss rates at opening degrees for which learning has not been completed are calculated in association with the respective opening degrees, by linear interpolation using the learnt values.

As shown in FIG. 6C, when the flow volume loss rate at the opening degree TH3 is newly calculated thereafter, then since this flow volume loss rate does not diverge by the predetermined value a or higher from the learnt value GK before updating, the learnt value is updated by storing this newly calculated flow volume loss rate.

According to the second embodiment described above, the following beneficial effects are obtained, in addition to beneficial effects similar to those of the first embodiment described above. Since the amount of change is limited in the updating of the learnt values, then it is possible to suppress sudden changes in the learnt values. As a result of this, it is possible to suppress large variation, before updating and after updating, in the learnt values, and in the characteristics of the throttle valve 4 which are corrected by using flow volume loss rates calculated by linear interpolation from these learnt values.

The respective embodiments described above can be modified as indicated below when implemented. In each of the embodiments described above, a detected value for the intake air volume which has been detected by the air flow meter 7 was used as the indicator value of the intake air volume which is actually detected. However, the invention is not limited to this, for instance, it is also possible to use another indicator, such as the detected value of a pressure sensor which detects the pressure inside the air intake passage 2. Even with a composition of this kind, it is possible to obtain similar beneficial effects to the first and second embodiments described above.

In the embodiments described above, a flow volume loss rate was used as a characteristic value. However, the invention is not limited to this, and it also possible to use a different parameter as a characteristic value, provided that the value indicates divergence between an indicator value of the intake air volume that is actually detected, and a reference value estimated from the opening degree of the throttle valve, for instance, the difference between the indicator value and reference value of the actually detected intake air volume.

In the respective embodiments described above, a characteristic value at an opening degree of the throttle valve 4 for which learning has not been completed is calculated by linear interpolation using learnt values for opening degrees for which learning has already been completed. However, this composition can be omitted in cases which the learnt values can be updated for virtually all opening degrees and there is no need to carry out linear interpolation, or the like. Even with a composition of this kind, it is possible to obtain similar beneficial, effects to the first and second embodiments described above.

What is claimed is:

1. A control apparatus for an internal combustion engine, the control apparatus comprising:

an electronic control unit configured to:

estimate a characteristic value indicating divergence from a reference value of an intake air volume, based on an actually detected indicator value of the intake air volume and an opening degree of a throttle valve;

store the characteristic value as a learnt value in association with the opening degree of the throttle valve at a time when the indicator value is detected;

calculate, in association with each opening degree of the throttle valve, the characteristic value for an opening degree of the throttle valve for which learning has not been completed, by linear interpolation using the learnt values;

learn the characteristics of the throttle valve and reflect the characteristics in control of the intake air volume, based on the characteristic values associated with the opening degrees;

update the learnt value for an opening degree of the throttle valve at which an engine rotation speed is equal to or greater than an idling rotation speed, by associating the characteristic value with the opening degree of the throttle valve at the time when the indicator value is detected and storing the characteristic value and the opening degree of the throttle valve at the time when the indicator value is detected, during an initial engine operation after initialization of the learnt values; and update the learnt value for an opening degree of the throttle valve at which the engine rotation speed is lower than the idling rotation speed, by storing a value equal to the learnt value for the smallest opening degree for which learning has already been completed, from among the opening degrees at which the engine rotation speed is equal to or greater than the idling rotation speed, and the updating of the learnt values is not carried out by associating the characteristic value with the opening degree of the throttle valve at the time when the indicator value is detected and storing the characteristic value and the opening degree of the throttle valve at the time when the indicator value is detected.

2. The control apparatus according to claim 1, wherein the electronic control unit is configured to update the learnt values for the respective opening degrees and make divergence between the learnt value before updating and the learnt value after updating less than a predetermined value.

3. A control method for an internal combustion engine, the internal combustion engine including an electronic control unit, the control method comprising:

estimating, by the electronic control unit, a characteristic value indicating divergence from a reference value of an intake air volume, based on an actually detected indicator value of the intake air volume and an opening degree of a throttle valve;

storing, by the electronic control unit, the characteristic value as a learnt value in association with the opening degree of the throttle valve at a time when the indicator value is detected;

calculating, by the electronic control unit, in association with each opening degree of the throttle valve, the characteristic value for an opening degree of the throttle valve for which learning has not been completed, by linear interpolation using the learnt values;

learning, by the electronic control unit, the characteristics of the throttle valve and reflecting the characteristics in control of the intake air volume, based on the characteristic values associated with the opening degrees;

updating, by the electronic control unit, the learnt value for an opening degree of the throttle valve at which an engine rotation speed is equal to or greater than an idling rotation speed, by associating the characteristic value with the opening degree of the throttle valve at the time when the indicator value is detected and storing the characteristic value and the opening degree of the throttle valve at the time when the indicator value is detected, during an initial engine operation after initialization of the learnt values; and updating, by the electronic control unit, the learnt value for an opening degree of the throttle valve at which the engine rotation speed is lower than the idling rotation speed, by storing a value equal to the learnt value for the smallest opening degree for which learning has already been completed, from among the opening degrees at which the engine rotation speed is equal to or greater than the idling rotation speed, and the updating of the learnt values is not carried out by associating the characteristic value with the opening degree of the throttle valve at the time when the indicator value is detected and storing the characteristic value and the opening degree of the throttle valve at the time when the indicator value is detected.

4. The control method according to claim 3, wherein the learnt values for the respective opening degrees are updated, and divergence between the learnt value before updating and the learnt value after updating is made to be less than a predetermined value.

* * * * *